United States Patent [19]

Petersen

[11] Patent Number: 4,775,136

[45] Date of Patent: Oct. 4, 1988

[54] SHEET FOLDING AND TRANSPORT SYSTEM, PARTICULARLY FOR PRINTED PAPER COPY SHEETS, AND FOLDED SHEET ELEMENT SEPARATING METHOD

[75] Inventor: Godber Petersen, Augsburg, Fed. Rep. of Germany

[73] Assignee: M.A.N. Roland Druckmaschinen AG, Offenbach am Main, Fed. Rep. of Germany

[21] Appl. No.: 56,787

[22] Filed: May 29, 1987

[30] Foreign Application Priority Data

Jun. 28, 1986 [DE] Fed. Rep. of Germany ..... 3621820

[51] Int. Cl.[4] ..... B65H 39/02

[52] U.S. Cl. ..... 270/54; 270/58

[58] Field of Search ..... 270/54–55, 270/58, 8–9, 11–12, 15, 17, 20.1, 45, 48–51; 493/405, 409, 416–417, 426, 432

[56] References Cited

U.S. PATENT DOCUMENTS

| | | | |
|---|---|---|---|
| 2,092,977 | 9/1937 | Kaster | 270/8 |
| 2,873,112 | 2/1959 | Crafts | 270/12 |
| 2,873,113 | 2/1959 | McWhorter | 270/12 |
| 3,162,434 | 12/1964 | Hepp | 270/54 |
| 3,392,890 | 7/1968 | Cramer | 493/405 |
| 3,580,562 | 4/1971 | Reist | 270/54 |
| 4,029,310 | 6/1977 | Reist | 493/426 |
| 4,231,559 | 11/1980 | Weschenfelder et al. | 493/426 |
| 4,275,873 | 6/1981 | Rathert | 270/54 |
| 4,465,269 | 8/1984 | Petersen . | |
| 4,605,212 | 8/1986 | Kobler . | |
| 4,605,213 | 8/1986 | Hechler . | |

FOREIGN PATENT DOCUMENTS 1436585 10/1968 Fed. Rep. of Germany .

*Primary Examiner*—Eugene H. Eickholt

*Attorney, Agent, or Firm*—Frishauf, Holtz, Goodman & Woodward

[57] ABSTRACT

To permit introduction of spreading fingers or insert sheet or sheet packages between essentially adjacent positioned sheet elements or halves (4*a*, 4*b*) of a folded sheet, the sheet is folded incompletely by extending a fold or spine or crease line or partly across the sheet while leaving a terminal portion in form of an open loop. The insert element, which may be spreading fingers (13, 23, 24), spreading disks (25, 26) or another sheet (31), is then engaged within the loop which, after insertion of the insert element, can be compressed, for example by cams (20) to form a crease also in the previous loop position. The transport of the incompletely folded sheet is carried out by transporting the sheet between, for example, transport belts, with the open loop projecting laterally from the transport belts so that they will not be squeezed or compressed.

18 Claims, 10 Drawing Sheets

4
6
8
9
13
15
16
17
18
19
20
21,22

SHEET FOLDING AND TRANSPORT SYSTEM, PARTICULARLY FOR PRINTED PAPER COPY SHEETS, AND FOLDED SHEET ELEMENT SEPARATING METHOD

Reference to related applications, assigned to the assignee of the present invention, the disclosure of which is hereby incorporated by reference: U.S. Ser. No. 056,786, filed May 29, 1987, Kobler et al; U.S. Ser. No. 060,764, filed June 10, 1987, Kobler et al; U.S. Ser. No. 056,857, filed May 29, 1987, Kobler et al. U.S. Pat. Nos. 4,465,269, Petersen; 4,605,213, Hechler; 4,605,212, Kobler, and all assigned to the assignee of the present application, the disclosures of which are hereby incorporated by reference.

Reference to related patent disclosure: German No. 14 36 585, Guggisberg.

The present invention relates to sheet-like substrate handling apparatus and a method to spread-apart folded sheet substrates, particularly printed copy paper sheets, which are being folded about a fold line to define a fold or spine and resulting sheet elements, and placement of an insert between the then folded sheet elements, so that later separation of the sheet elements is readily possible, for example to provide for insertion of additional printed subject matter.

U.S. Pat. No. 4,605,213, Hechler, assigned to the assignee of the present application and the disclosure of which is hereby incorporated by reference, describes an arrangement in which an opening cylinder permits gripping folded sheets or sheet packages at a leading spine or fold. The overhang of each item is grasped by rearward grippers, and the folded elements, after being released from a transport system, for example a conveyor belt, will open due to centrifugal force, when being guided in a rotary path, or, for example, by an electrostatic charging device which so charges the sheet elements that they are being repelled when released.

U.S. Pat. No. 4,605,212, Kobler, assigned to the assignee of the application, and the disclosure of which is hereby incorporated by reference, describes an arrangement in which folded products are accepted and transported by grasping the folded spine of the folded product and inserting, laterally, driver elements into the wedge-shaped region adjacent the fold. The driver elements are located on an endless transport apparatus, spaced from each other, the drivers permitting or causing spreading of the sheet elements which are folded about the fold or spine.

To open the folded sheets, that is, to spread the sheet elements apart when having been handled in the apparatus of U.S. Pat. No. 4,605,213, Hechler, for example to introduce inserts into the folded sheet or sheet package, an overhang region is necessary which increases the use of paper required. To spread apart the folded sheets handled in accordance with U.S. Pat. No. 4,605,212, Kobler, it is necessary to so operate the system that the drivers can be rapidly inserted, laterally, into the sheets, which is difficult to achieve in high-speed systems.

German Pat. No. 14 36 385, Guggisberg, describes an arrangement to open folded sheet elements, for example newspapers, periodicals, catalogs and the like, by introducing insertion elements which are forcibly pushed into the folded sheet elements while the folded sheet elements are held in compression between a counterplate and an elastic finger. Such an arrangement does not permit precise introduction of the insertion element between precisely predetermined sheet elements of a sheet package.

THE INVENTION

It is an object to provide a folding and transport arrangement in which sheets can be folded to form a fold line or spine and two sheet elements, and which permits insertion of additional elements precisely between the sheet halves or sheet elements, without the necessity of overhang material or insertion braids or the like, and which can reliably operate at high speed.

Briefly, a sheet is folded such that it is incompletely folded at the region of the fold or spine to form an open loop, rather than a sharp crease, somewhat like a noose. The sheet elements adjacent this loop or noose can be close to each other. It is then readily possible to introduce fingers or other elements, such as separating elements, selectively in said loop between the sheet elements. The sheet elements can be transported, by engagement for example between transport belts which transport these incompletely folded sheets at least in the region outside of the loop close to the fold.

The apparatus and method, thus, provides for folding, at least part of the sheet, in such a way that in the region of the fold line the sheet will form a loop which is somewhat similar to the cross section of a teardrop into which separating elements to then separate the adjacent sheet elements beyond the region of the open loop can be placed.

DRAWINGS

Figure 1:
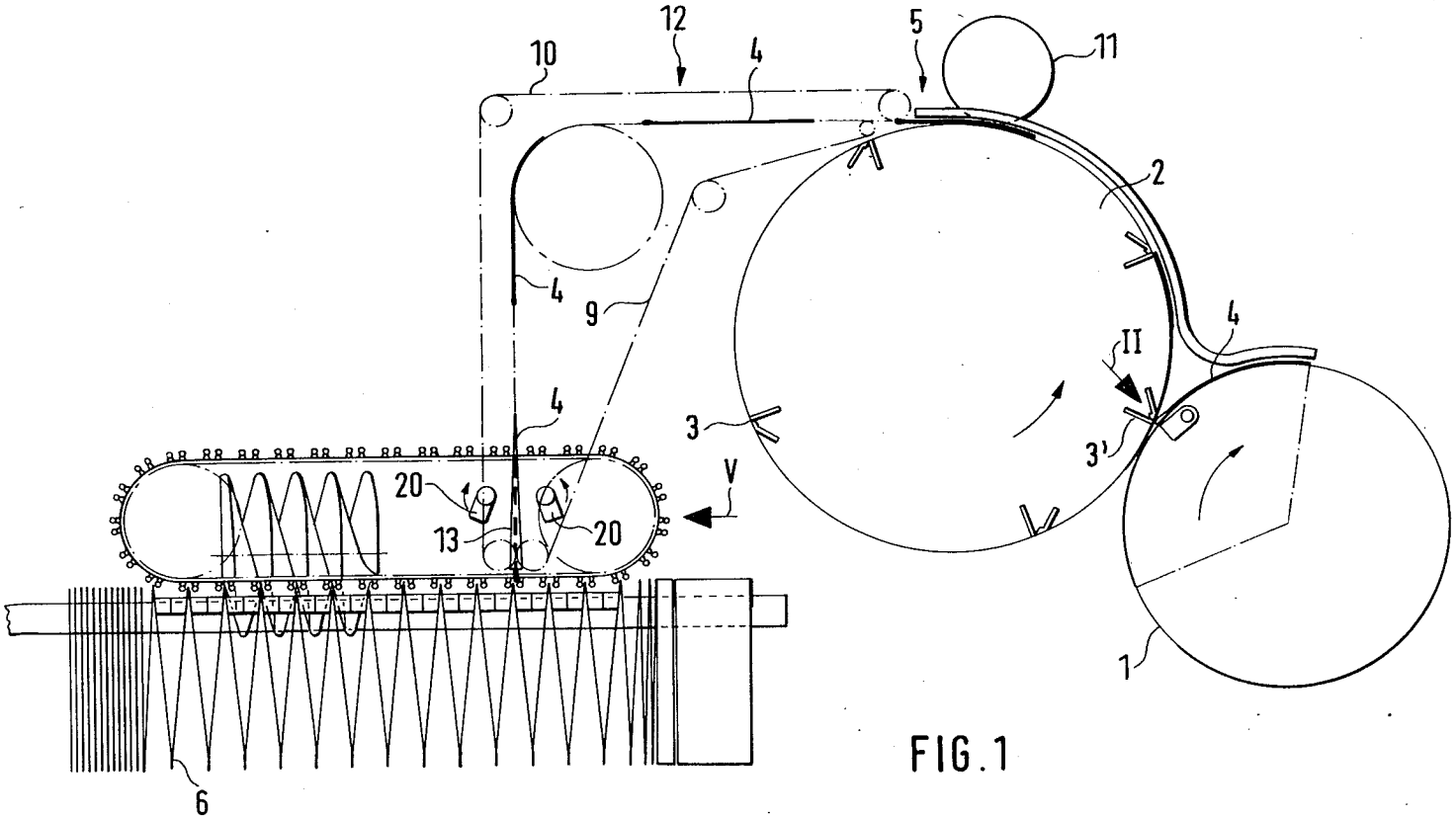
FIG. 1 is a highly schematic side view of an overall apparatus for folding and transporting folded sheets.

In the discussion and claims which follow, reference will be made to "folded sheets". It is to be understood that the term "sheet" may equally refer to packages of sheets, positioned above each other, for example multiple pages of a newspaper or the like. Since paper sheets can be very thin, a plurality of such superimposed sheets, and forming sheet packages, can be handled at one time. The reference to "sheet", therefore, is to be understood to also include sheet packages, that is, the plural; and the term "sheet" will be used for convenience and ease of reading.

DETAILED DESCRIPTION

The folding apparatus includes well known structural elements. A collection and folding blade cylinder 1 receives sheets to be folded, and transfers, for further transport, the sheets to a folding flap cylinder 2. The sheets, folded by insertion of a folding blade from the folding blade cylinder 1—as well known—into the flaps of the folding flap cylinder 2, are then transferred to a region 5 for further transport to a storage and transport system 6. A belt transport system formed by transporting belts 9, 10 transfers the sheets from the region 5 to the system 6. Folded sheets or packages or plurality of sheets—see above definitions—are thus transferred by the belt system 9, 10. Preferably, the belt system 9, 10 operates at a linear speed which is less than the circumferential speed of the cylinders 1 and 2. The folding flap cylinder 2 has folding flaps 3 therein. To transfer a sheet, and fold the sheet into a fold 4, a folding blade 7 (FIG. 3) is pushed against the sheet, for example in an intermediate region thereof, from the folding blade cylinder 1.

Figure 2:
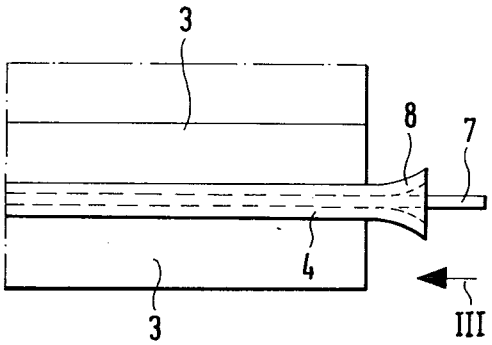
FIG. 2 is an enlarged fragmentary side view of the embodiment of FIG. 1.
Figure 3:
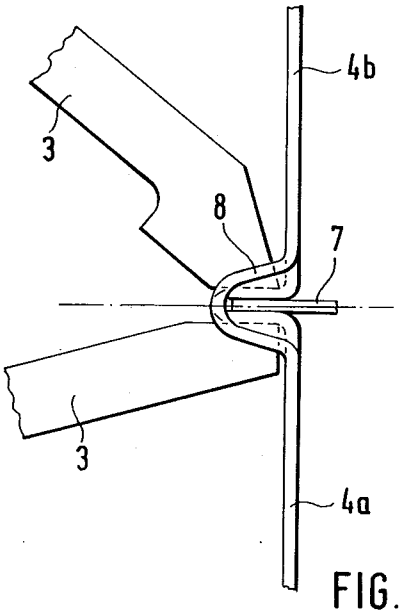
FIG. 3 is an enlarged fragmentary view of folding flaps of a folding flap cylinder.

In accordance with a feature of the invention, the fold is not carried out over the entire transverse width of the sheet but, rather, at the position 3' (FIG. 1), over a portion of the transverse region. FIG. 2 illustrates a portion of the insertion region, taken in the direction of the arrow II of FIG. 1, and in an enlarged view. The folding flap 3 is foreshortened with respect to the width of the sheet to be folded and, preferably, also foreshortened with respect to the folding knife or blade 7. Consequently, upon introduction of the blade into the sheet, or portion of the sheet, a loop 8 will form, since the sheet is not sharply creased in this direction, the folding flaps 3 not engaging the sheet in the edge zone, generally shown at 8' in FIG. 2. FIG. 3 is a side view, taken in the direction of the arrow III of FIG. 2, and illustrating the folding. A sharp crease is formed in the region 4' (FIG. 2) of the sheet, where it is gripped between the folding flaps or gripper elements 3 (FIG. 3). Of course, the folding flaps 3 can be foreshortened also at the side of the sheet not shown in FIG. 2, so that open loops 8 can be formed on both sides of the folded sheet 4, if such is desired.

Figure 4:
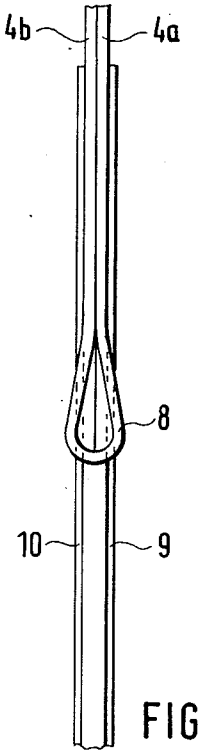
FIG. 4 is an enlarged fragmentary top view illustrating transport of folded sheets, leaving an open loop.

It is, of course, equally possible to utilize standard folding blade cylinders which have the folding flaps 3 extending towards the end of the folding flap cylinder and feeding the sheet laterally shifted, so that the sheet will assume the position shown in FIG. 2, by extending at one side out beyond the ends of the folding flaps or grippers 3, and also over the associated folding blade 7 which, in contrast to FIG. 2, would be in alignment with the folding flaps 3. In this embodiment, also, the extending portion will not be sharply creased, but only loosely folded, so that the loop 8 will result. FIG. 4 illustrates, in an enlarged view, the formation of the loop 8.

The sheets 4, after having been folded, are transferred in region 5 to the belt transport system 9, 10. A transport roller 11 is preferably provided to facilitate the transfer. Belts 9, 10, preferably, operate with lesser speed than the circumferential speed of the folding flap cylinder 2. FIG. 4 illustrates, enlarged, how the sheet 4 is guided between the belts 9, 10. As can be seen, the loop 8 is not pressed or caught between the belts 9, 10 but, rather, extends laterally therefrom. In accordance with a feature of the invention, thus, the sheet 4 is incompletely creased, while being folded, to leave at the edge the loop 8 which, as can be seen in FIG. 4, has approximately the form of a teardrop, taken in cross section. The not completely creased but folded sheet 4 is thus formed, and then transported in such a manner that the loop 8 remains. During transport, the loop 8 should not be compressed, that is, squeezed together to form a sharp crease 4'. The formation of the fold, in which a portion of the folded sheet is creased and another portion is not completely creased but generates the loop 8, is referred to in the specification and claimed as an "incomplete" fold.

In accordance with a feature of the invention, the incomplete fold can also be generated by a folding roller pair, between which a sheet or sheet package to be folded is pushed by a folding blade. Such folding apparatus are referred to as drum folds and, usually, are used to form longitudinal folds. By suitable foreshortening of the folding rollers, or by laterally offsetting the sheet, an incomplete fold can be generated so that, in dependence on whether the sheet is merely laterally offset or has a wider dimension than the folding rollers, one or two loops 8 will be formed at one or both sides of the respective sheets. Similarly, folding machines of other constructions which fold sheets can be used, and the present invention can be equally applied.

Rather than using belt transport systems as shown in FIGS. 1 and 4, to receive and further transfer the folded sheets 4, other transport systems, such as chains, or grippers carried on belts or chains can be used. Again, the grippers or holders on belts must grip the folded sheets 4 inwardly of the region of the loops 8, so as to leave the end loops 8 open and undisturbed.

Figure 5:
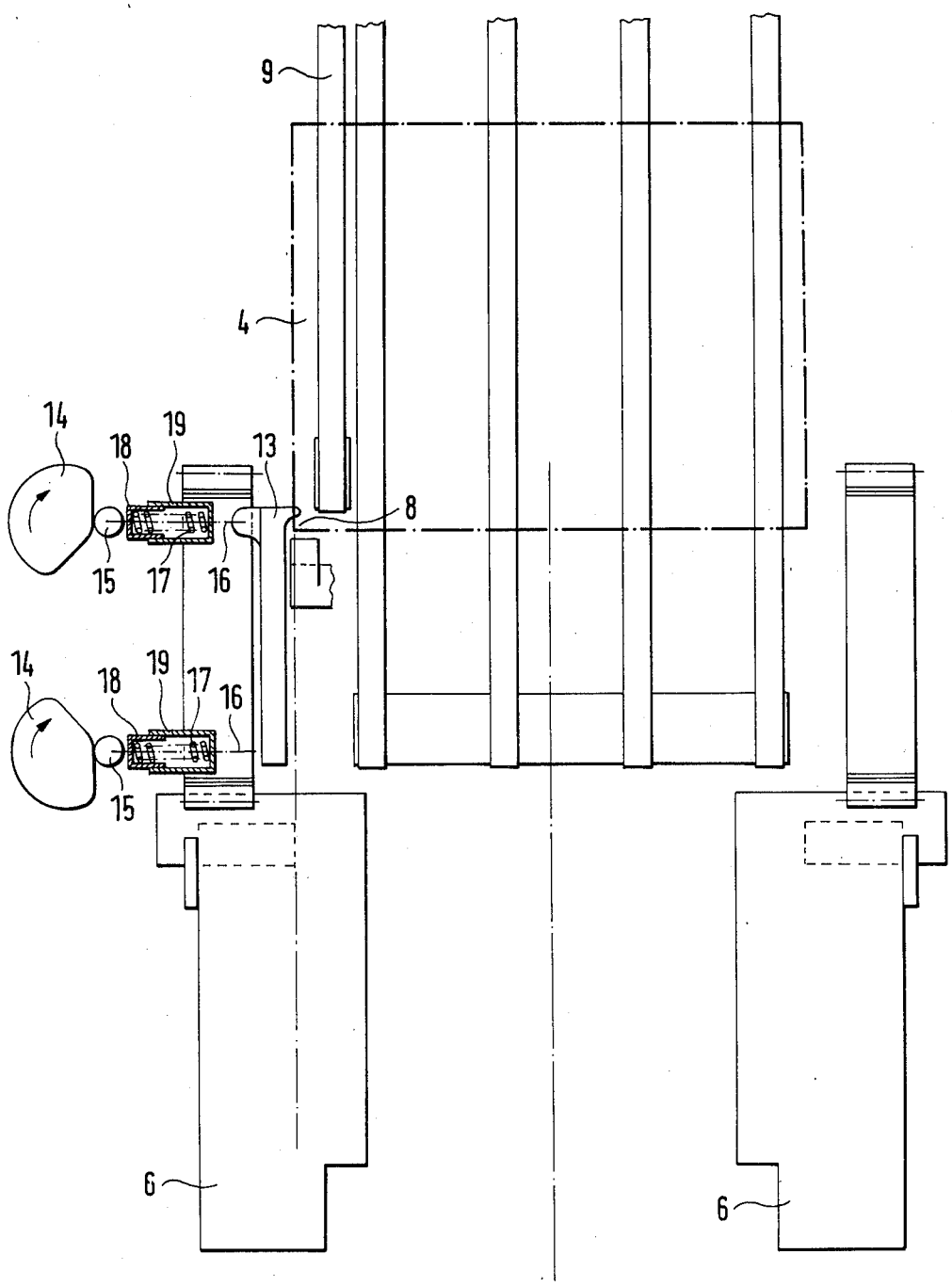
FIG. 5 is an enlarged fragmentary view of the system illustrating positioning of an insertion blade, taken along the arrow I of FIG. 1.

FIG. 5 is a view taken in the direction of arrow I of FIG. 1, and illustrating a controlled finger element 13, formed with a projecting tip, engages in the loop 8 in the end region of the transport belts 9, 10. The sheets 4 are transferred in that region to a storage and transport system 6 which is pulled apart by a worm, and transported by a gear belt or the like, to define compartments to receive the folded sheets 4. Generally, the storage system is formed by interconnected elastic sheet elements, arranged in zig-zag form.

Between the elastic sheet elements, which may be of metal or plastic, V-shaped carrier arms are located which, upon spreading of the zig-zag or accordeon-pleated structure, likewise are spread apart. Thus, when spread apart, folded sheets having a central crease 4' and sheet portions or elements **4*a*, 4*b* (FIGS. 3, 4) and the loop or loops 8 can be received, in spread-apart state or condition, to permit insertion or mixing steps with other sheets, sheet packages or copy products, or for storage in compact form. Reference is made to the copending application U.S. Ser. No. 56,786, filed May 29, 1987, Kobler et al for a description of a preferred system suitable for cooperation with the folding and transport system including the cylinders 1, 2 and the belt system 9, 10, for example. The storage unit should, for cooperation with the system and method of the present invention, be capable of receiving the incompletely folded sheets 4 with the loop 8 in spread-apart condition for transfer to the storage and transport position 6. The wedge-shaped finger 13 see, for example, FIGS. 10–13, is guided in movement to-and-fro by an upper and a lower respective cam disk 14, 14'. The cam disks 14, 14' are engaged by suitable cam follower rollers 15 which, over push rods 16, engage, respectively, the upper and lower regions of the finger 13. The finger 13, thus, can be tilted or tipped by the respective cam disks 14, 14'. Springs 17 press the cam followers 15 against the cam disks 14, 14', as well known; sleeve elements 18, 19 are used for guidance of the springs. The bolts or rods 16** are shown only schematically, since the mechanical construction is one of mere engineering design and can be in accordance with any suitable arrangement.

The sequential steps for spreading the sheet elements 4*a*, 4*b* are best seen in the sequence of drawings FIGS. 6–9 and FIGS. 10–13, to be considered together.

Figures 6, 7, 8, 9:
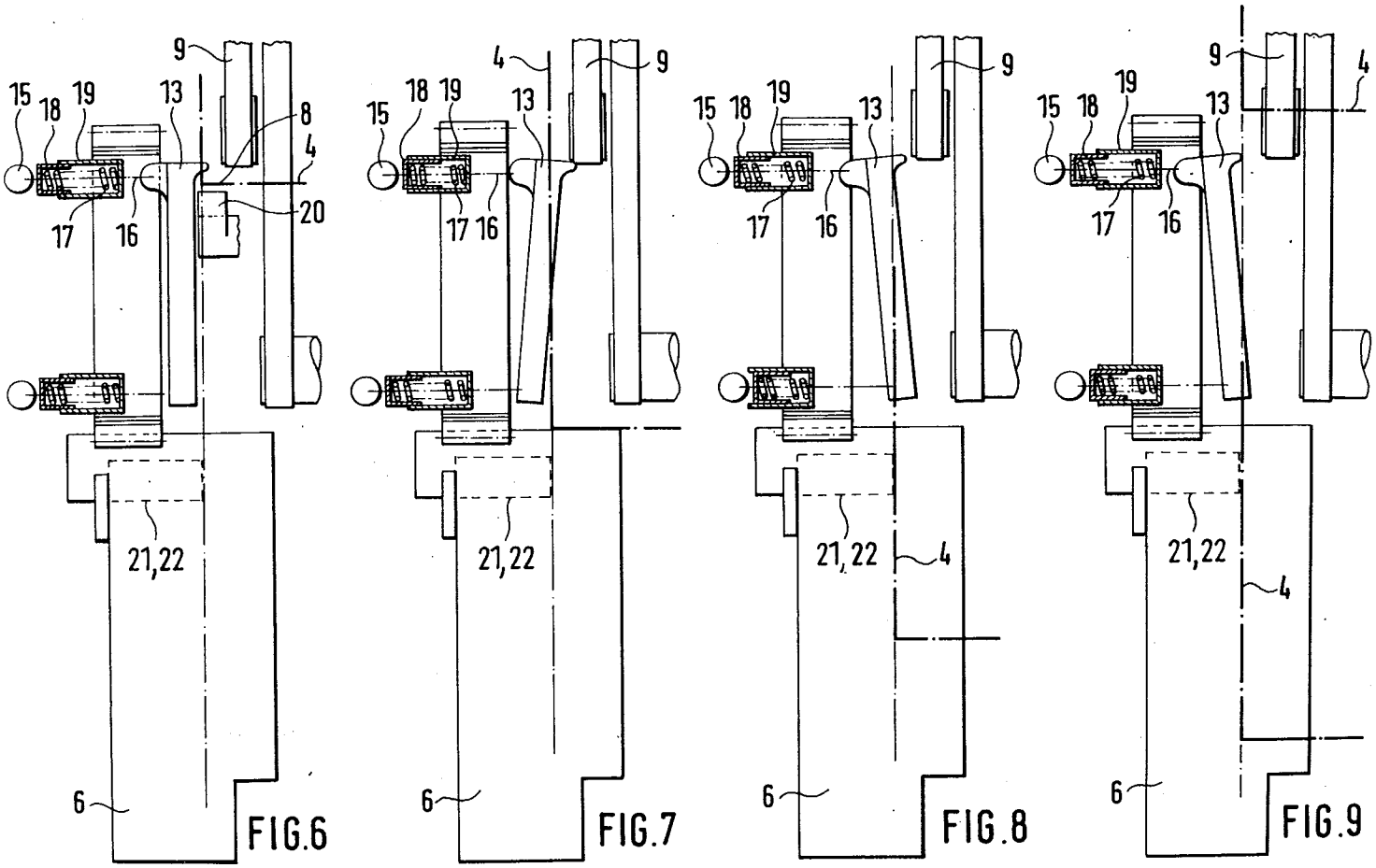
FIGS. 6, 7, 8 and 9 are enlarged side views illustrating, sequentially, transfer of a folded product to a storage bin, with spreading of the respective sheet elements.
Figure 10:
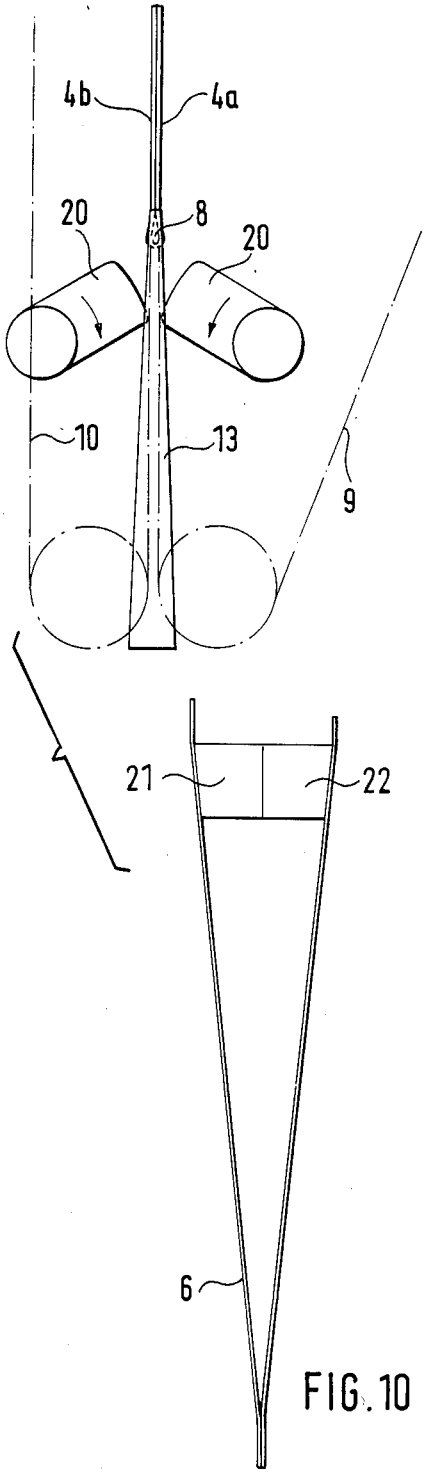
FIGS. 10 to 13 are side views illustrating spreading of the sheet elements, and showing the arrangement for spreading which is shown in end view in FIGS. 6 to 9.
Figure 11:
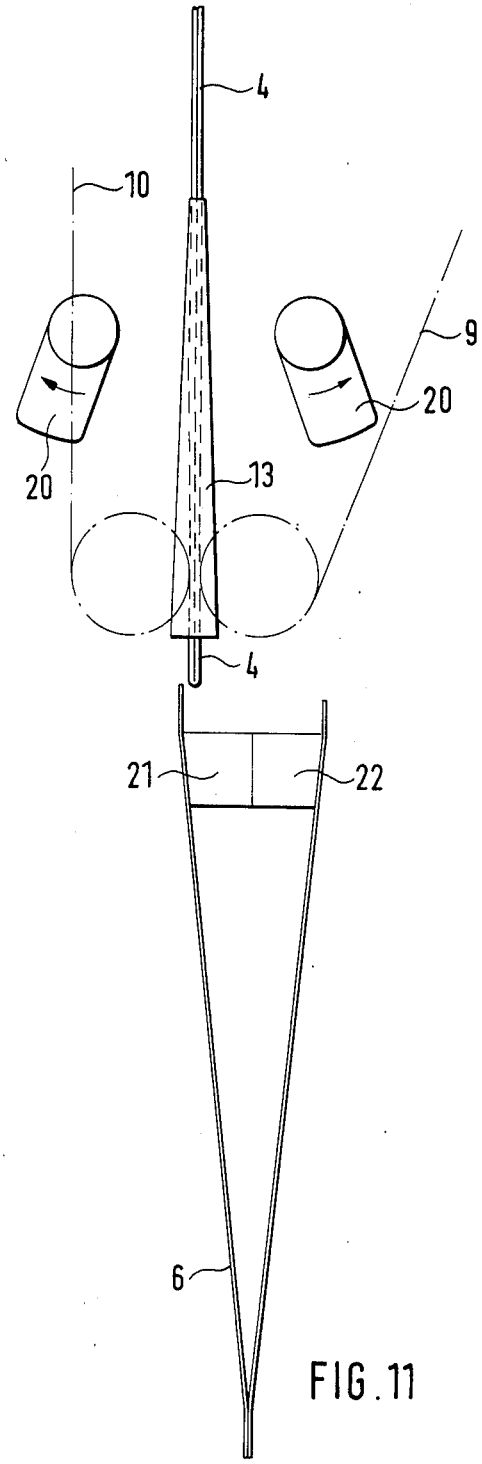
Figure 12:
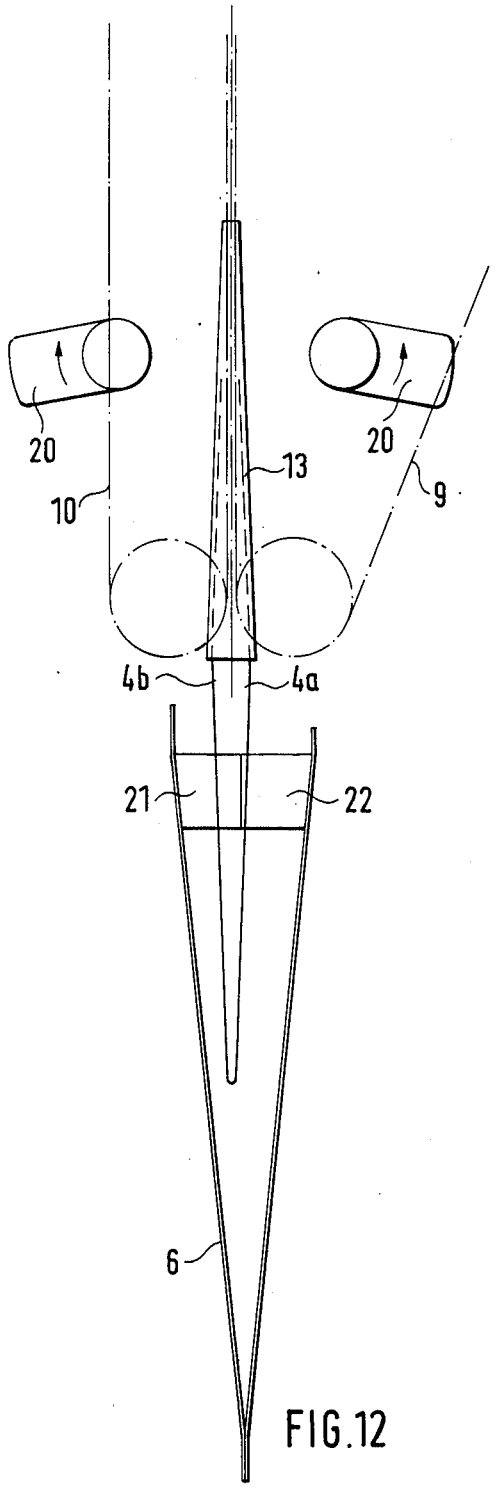

The folded sheets 4 are opened by the fingers 13. After introduction of the tip 13'—identified only in FIG. 8 for clarity of the drawing—into the loop 8 between the sheet elements or halves 4*a*, 4*b* of the sheet 4 guided by the belts 9, 10, the sheet is transported by cams 20 rotating in the direction of the arrow. The cams 20 have projecting elements to crease the loop 8 by pressing the sheet elements 4*a*, 4*b* in the region of the loop 8 together - see FIGS. 6 and 10. As the sheet is pulled further downwardly, see FIGS. 7 and 11, the finger 13 engages further within the loop 8 between the sheet elements 4*a* and 4*b*. The cams 20 have rotated further in order to provide for space for the additional tipping insertion of the finger 13. FIG. 8 and the associated side view of FIG. 12 illustrate the next step in which the upper portion of the finger 13 leaves the region between the sheet elements 4*a* and 4*b*. A lower and thicker part of the finger 13 can now engage between the sheet elements 4*a* and 4*b* to spread apart the sheet elements of the folded sheet 4, so that V-shaped holder and spreader elements 21, 22 (FIGS. 10–13) of the transport system 6 can penetrate between the sheet elements 4*a* and 4*b* for further transport in the transport system 6.

Figure 13:
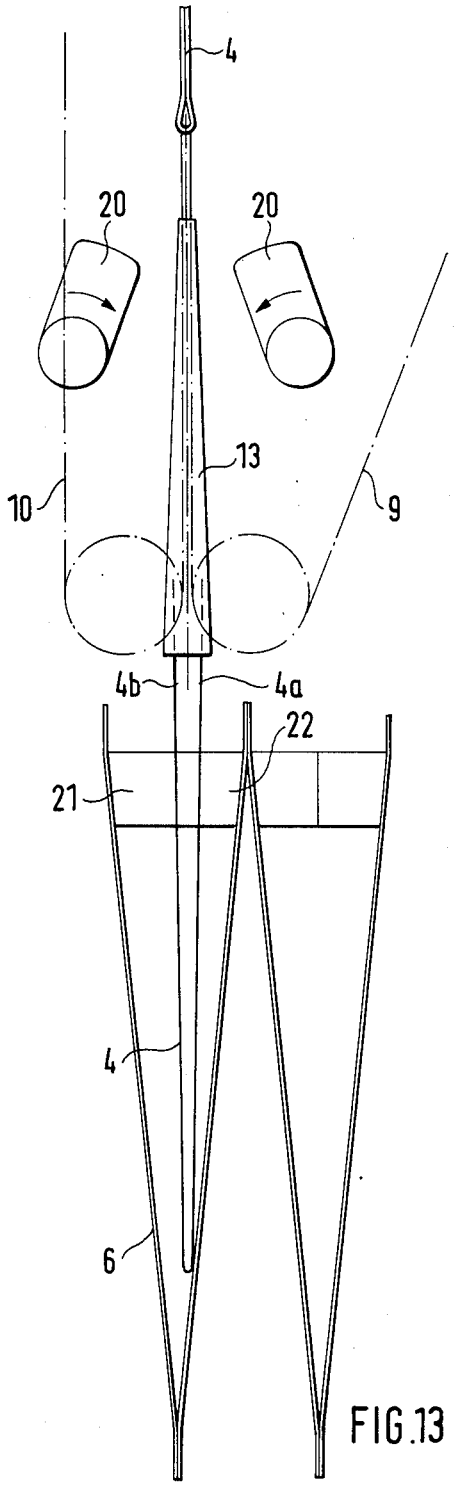
Figures 14, 15, 16, 17:
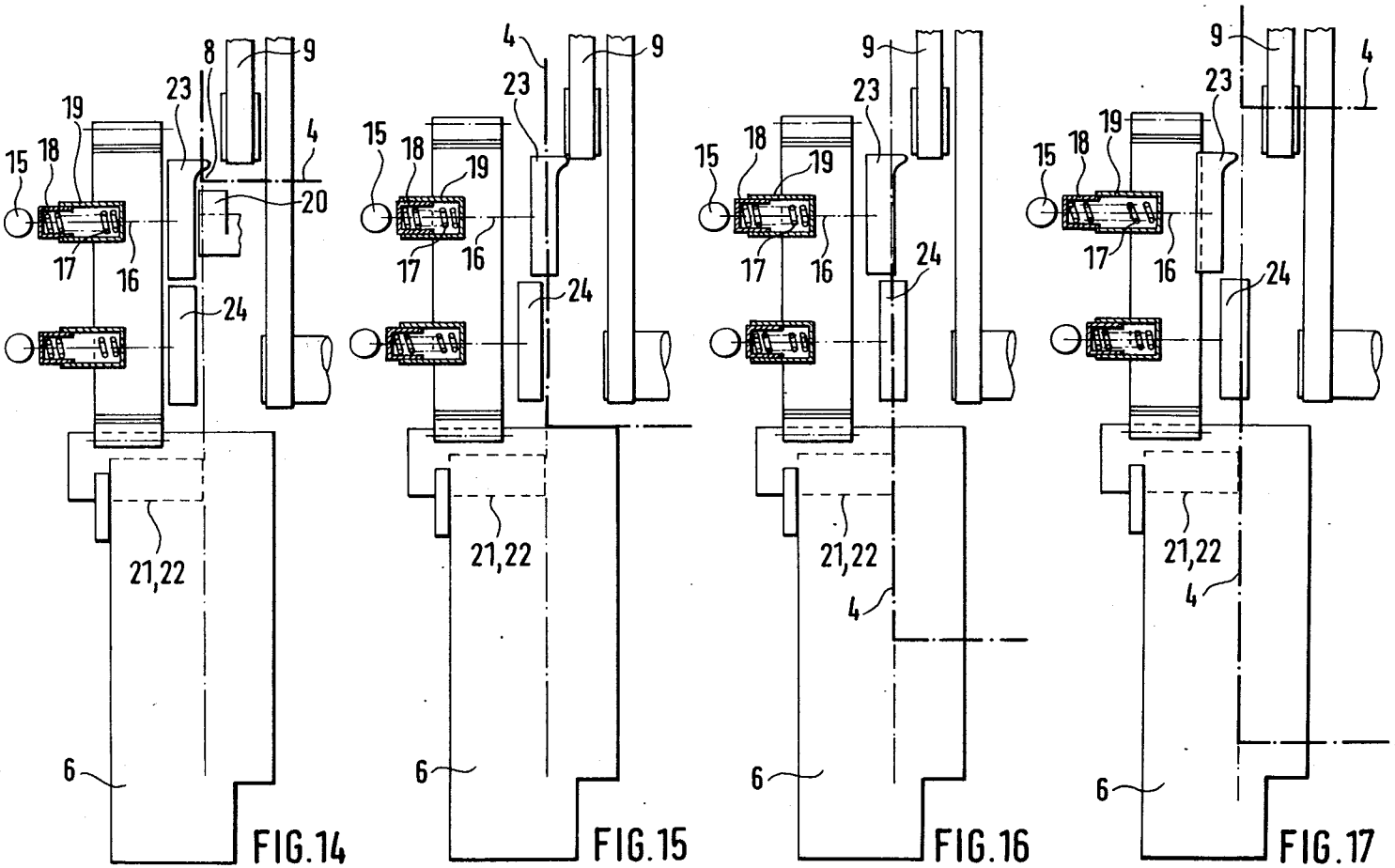
FIGS. 14 to 17 illustrate a modified form of insertion element in the sequential insertion and transfer steps shown in FIGS. 6 to 9.
Figures 18, 19, 20, 21:
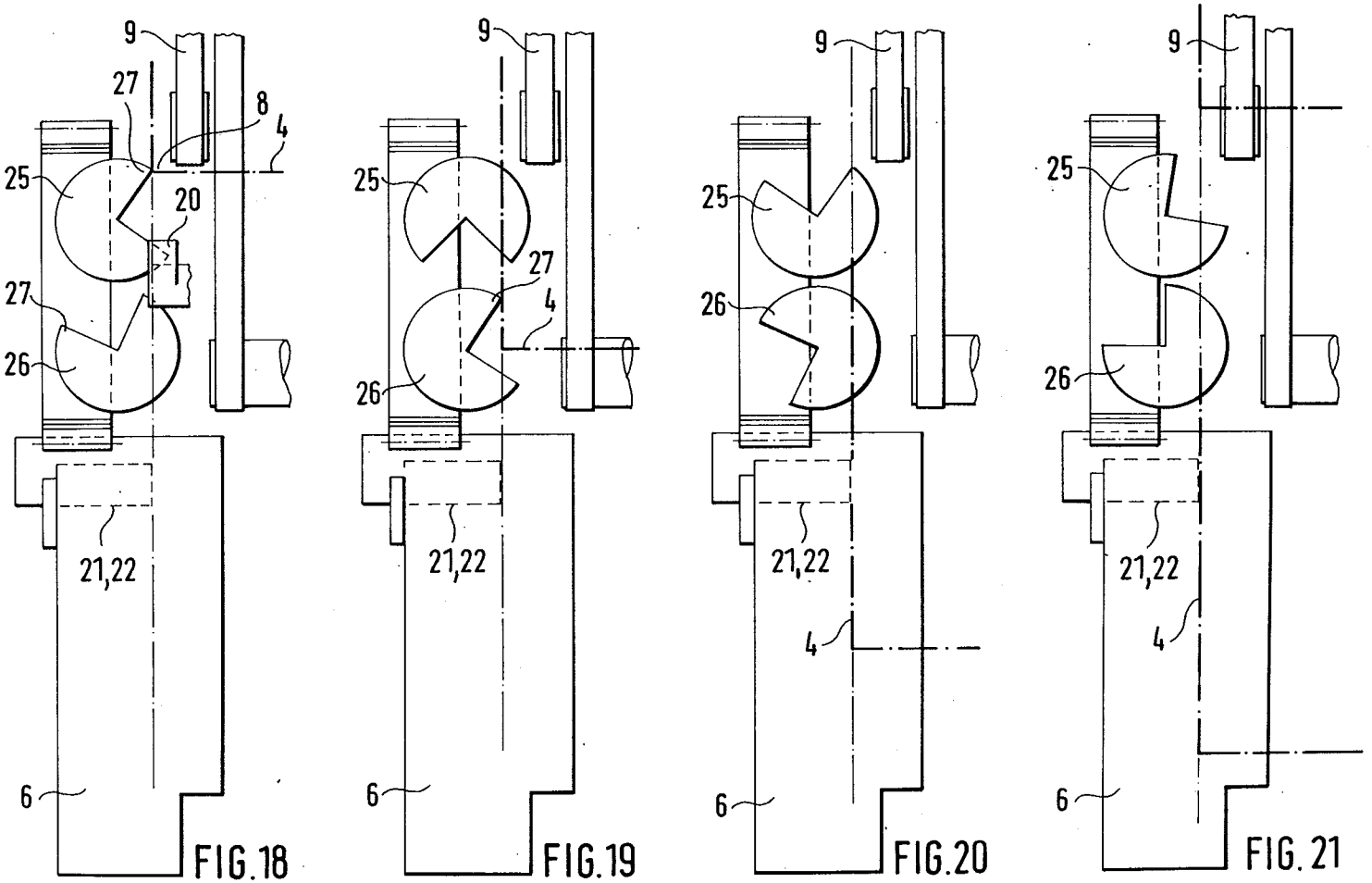
FIGS. 18 to 21 illustrate another embodiment of an insertion element, and showing different insertion steps corresponding to FIGS. 6 to 9.
Figure 22:
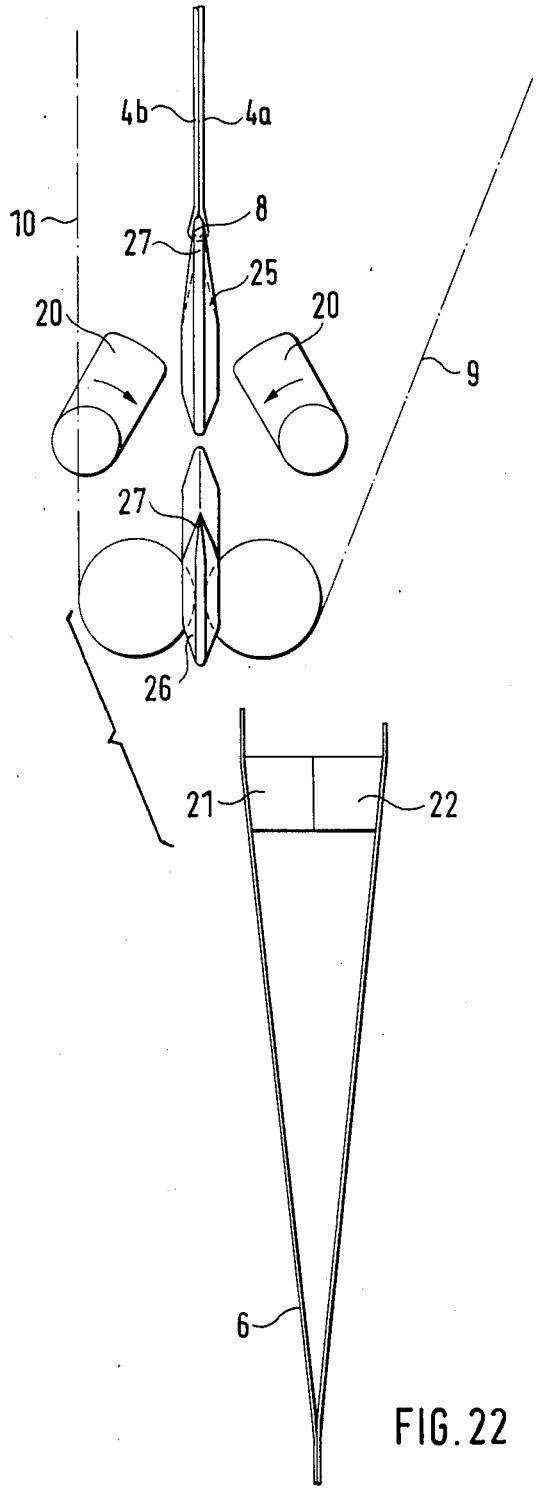
FIG. 22 is a side view of the embodiment of FIGS. 18 to 21, and showing the position of the element as illustrated in FIG. 18.

FIGS. 9 and 13 show the position in which the finger is withdrawn, with the tip 13' beyond the edge of the sheet, shown by a chain-dotted line, ready for penetration into the next folded sheet 4. The lower portion of the finger is still in the region of the previously penetrated sheet 4, and ready for withdrawal.

The rotating compressing cam 20, shown only schematically, is not absolutely necessary if the loop 8 need not be creased, so that a crease line 4' need not, in the finished product, extend over the entire width of the folded sheet 4. In many instances, the completion of a crease in the region of the loop 8 is not needed. The folding and storage unit 6, additionally, has a creasing effect, as can be seen in FIG. 13, by considering that the sheet 4 will fall towards the bottom of the zig-zag plate-like elements of the storage system 6.

The finger 13 can be supported on the machine in any suitable manner, and the floating support permitting both tilting as well as shifting movement, as illustrated in FIGS. 6 to 9 is readily obtained by mounting the finger 13 on a pivot which, itself, is movable from right to left, with respect to FIGS. 6–9 in accordance with the respectively instantaneous positions of the cams 14, 14' (FIG. 5). Such support and suspension has been omitted from the drawings for clarity, since what is important is the respective movement and sequence of movements, rather than the specific mechanical structure, which is a matter of design.

FIGS. 14 to 17 illustrate another way of providing for spreading of the sheet elements 4*a*, 4*b*. A two-element finger is used, having two finger portions or parts 23, 24 which are operated independently of each other, but otherwise in the same manner and having the same effect as described in connection with FIGS. 6 to 13. Control, likewise, is similar, for example by cams 14, 14'. The finger elements 23, 24, thus take on the function of the single finger 13. FIGS. 14–17 correspond to FIGS. 6–9. Finger 24, preferably, is wedge-shaped, and has the larger, lower end as illustrated with respect to finger 13 in FIGS. 10–13. This arrangement permits support and suspension of the respective fingers 23, 24 directly from the associated bolt element 16. Finger 23 is formed with a finger tip, similar to finger 13, and not further numbered in FIGS. 14–17, for clarity of the drawing.

FIGS. 18–22 illustrate another arrangement to permit spreading-apart of the sheet elements 4*a*, 4*b*, by using rotating disks 25, 26, rotating in synchronism as the folded sheet 4 is being fed downwardly by belts 9, 10. The disks have a segment cut out, as best seen in FIGS. 18–21, and have, essentially, the shape shown in FIG. 22 in side view, that is, looked at from a radial position, double-wedge-shaped with the wedge shape of finger 25 being non-symmetrical with respect to the rotary axis of the disks. As best seen in the respective drawings, the disks are formed with a tip 27 which is designed to engage in the loop 8. As the sheet halves 4*a*, 4*b* are spread, the disks 25, 26 rotate so that, as the thickness of the disks increases upon rotation, the sheet halves 4*a*, 4*b* are spread apart. The spreading-apart of the sheet halves 4*a*, 4*b* thus occurs, in general principle, similarly as previously described with respect to the fingers 13 or the finger elements 23, 24. The segmental recess in the disks 25, 26, and their rotation, in synchronism, can be so matched to the rotation and position of the compression cams 20 that the compression cams 20 are operated in predetermined circumferential relationship with respect to the disks 25, 26.

It is not necessary, always, to introduce spreading fingers 13, 22, 23 or the disks 25, 26 into the loops 8. Rather, and in accordance with a feature of the invention, inserts can be introduced into the loops from the side of the folded sheets 4. These inserts may, themselves, be folded sheets or groups of sheets. They may, for example, contain advertisement material, announcements of sales, or the like. Such additional copy products or other sheet products can be introduced from one side where a single loop has been formed or, if two loops have been formed at both sides—in accordance with the discussion in connection with FIGS. 4–2—sheets or other products can be inserted from both sides, for example from the right and left side of the folded sheet 4.

Figure 23:
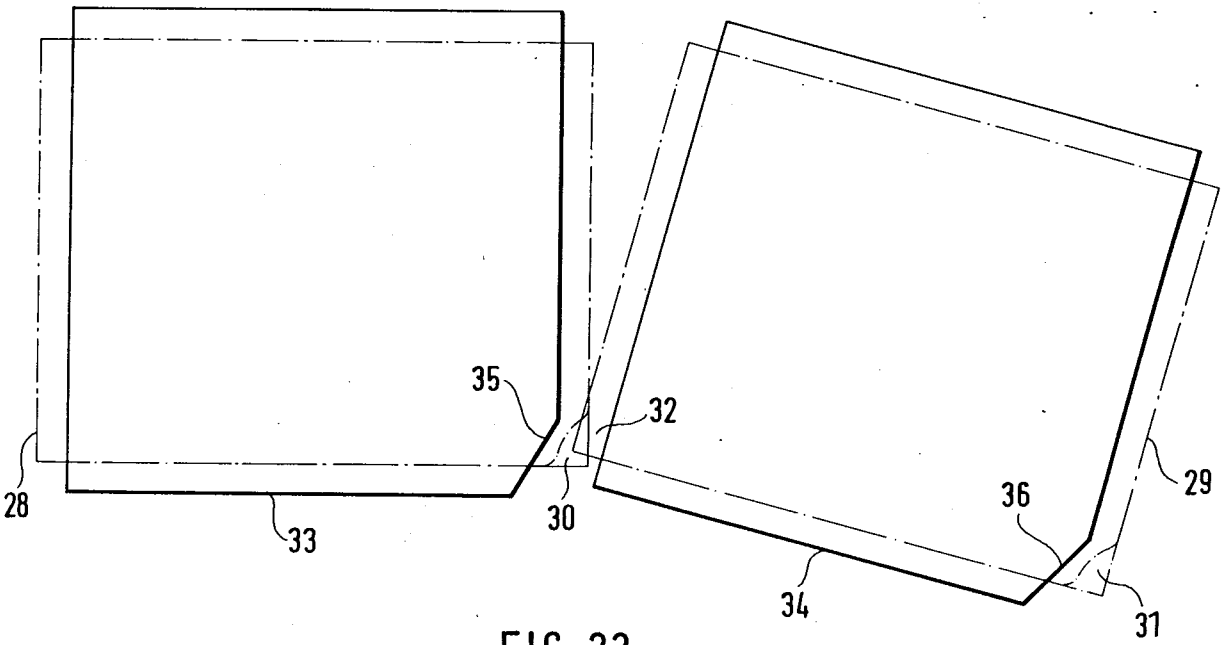
FIG. 23 illustrates a transfer apparatus to position folded sheets within or among each other.

FIG. 23 illustrates interleaving of two incompletely folded sheets 28, 29, each formed with a loop 30, 31 within each other. The sheets 28, 29 are held between suitable plate elements 33, 34, respectively, and so positioned that the corner 32 of the sheet 29 can be moved, in controlled direction and controlled manner, into the loop 30 of the incompletely folded sheet 28. The plate elements 33, 34 are formed with recesses or cut-away corners 35, 36, so that the respective loops 30, 31 are retained. In a further step, obvious from the foregoing, and not specifically shown, the sheet or sheet package 29 is completely pushed between the respective halves or elements of the sheet or sheet package 28. Grippers are especially suitable for such a transfer operation. Such grippers may be positioned to grip the sheet 29 at the top and introduce it into the sheet 28 by lateral movement, in FIG. 23 from the right towards the left.

The movement of such grippers can be easily determined by moving the grippers along a suitably shaped guide rail. Upon storage of the thus interleaved or interlaced sheets 28, 29, the loop 30 of sheet 28, and loop 31 of sheet 29 will be retained, so that further insertion steps can be carried out, as desired.

The loops 8, 30 or 31 thus can be used to introduce fingers or finger elements or disk element or other structural spreader parts, as well as additional folded products, such as folded sheets or sheet packages which, themselves, may include the loops 31 for still further introduction of additional folded sheets or sheet packages which, in turn, may have loops formed thereon.

Various changes and modifications may be made, and features described in connection with any one of the embodiments may be used with any of the others, within the scope of the inventive concept.

I claim:

1. Sheet folding and transport system, for folding and transporting substrate sheets (4), particularly printed paper sheets received from a printing machine, in which the sheets (4), when folded, define a fold or spine (4') and essentially adjacently positioned sheet halves or elements (**4*a*, 4*b*), said system comprising, in accordance with the invention, a folding means (1, 2, 3; 7) engaging a sheet and incompletely folding said sheet by bringing together portions of the sheet which, when folded, will form the sheet elements while leaving an open loop (8) in the region of the fold or spine (4**);

transport means (9, 10) engaging the incompletely folded sheet at least in the region outside of said open loop;

and insert means (12, 23, 24, 25, 26, 31) selectively insertable in said open loop and between the sheet elements.

2. The system of claim 1, wherein said folding means comprise a folding flap cylinder (2) having folding flaps (3), the folding flaps being shorter than the width of the folded sheet (4) so that said folded sheet will be formed with a fold or spine or crease over only a portion of the width thereof, leaving the remainder of the width of the sheet in the form of said loop (8).

3. The system of claim 2, wherein said transport means comprises means engaging said folded sheet in zones thereof outside of said loop, and leaving said loop projecting laterally from said transport means.

4. The system of claim 3, wherein said transport means comprises a belt system (8, 9) transporting said folded sheets (4) between the belts, while leaving the loops (8) projecting laterally therefrom.

5. The system of claim 3, wherein the insert means comprise a movable controllable finger means (13, 23, 24, 25, 26) positioned laterally of said transport means and engageable within said loop.

6. The system of claim 5, further including compression means (20) located adjacent the transport means and engageable against said sheet elements (**4*a*, 4*b***) to compress the sheet elements together in the region of said loop to form the loop into a crease, said compression means being positioned downstream with respect to said finger means at the position in which the finger means is insertable in the loop, to compress the loop after insertion of the finger means therein.

7. The system of claim 5, further including operating means (14, 15, 16, 17, 18, 19) engageable with said finger means and controlling movement of the finger for first engaging a tip portion (13) of the finger means in the loop and then engaging a remaining portion of the finger means between said sheet elements.

8. The system of claim 7, wherein said operating means comprises a control cam (14, 14') and connecting means (14-19) tipping and moving said finger means for introducing the tip portion and said further portion between the sheet elements.

9. The system of claim 5, wherein said finger means comprises a multi-part element having two finger elements (23, 24);

operating means (14, 14', 15, 16, 17) are provided respectively engageable with said finger elements and controlling insertion of a first finger element having a tip portion in said loop (8) and then introducing a second finger element which is at least in part wider than said first finger element between said sheet elements (**4*a*, 4*b*) of the sheet (4**).

10. The system of claim 5, wherein said finger means comprises at least one rotating disk formed with a cutout to define an edge (27) which, with the circumference of the disk, defines an insertion tip engageable in the loop (8) and between said sheet elements (**4*a*, 4*b***).

11. The system of claim 5, wherein said finger means are wedge-shaped and tapering to a wider portion from a tip portion (13') and first engageable in said loop (8).

12. The system of claim 1, further including a storage structure (6) including selectively expandable and compressible compartments, said transport means feeding the sheets to said storage structure (6) when the compartments are in expanded condition.

13. The system of claim 1, wherein said insert means comprises a further sheet (29) laterally insertable within the loop (30) of said first-mentioned sheet (28).

14. A method of folding and transporting substrate sheets, particularly printed paper sheets received from a printing machine, in which the sheets (4), when in folded condition, define a fold or spine, and essentially adjacently positioned sheet elements (**4*a*, 4*b*), comprising the steps of incompletely folding said-sheets to form said fold or spine in shape of a crease extending only across a portion of said sheet, while leaving an open loop (8) at an end portion of the sheet beyond said crease (4'**);

transporting said sheet with the open loop intact;

and inserting insert means (13, 23, 24, 25, 26, 31) between the sheet elements (**4*a*, 4*b*) by first inserting said insert means in the open loop (8**) to thereby permit insertion of the insert means between the essentially adjacently positioned sheet elements upon relative movement of said insert means and the folded sheet.

15. The method of claim 14, including the step of forming a crease in the region of the loop (8) after introduction of said insert means (13) into the open loop.

16. The method of claim 14, including the step of spreading the essentially adjacently positioned sheet elements at least in the region along the sheet elements in alignment with said loop.

17. The method of claim 14, wherein the insert means include a further substrate sheet;

and wherein the step of inserting said insert means comprises inserting said further substrate sheet with a corner thereof in said loop and then sliding the substrate sheet between said sheet elements (**4*a*, 4*b***) to thereby separate said sheet elements, with the substrate sheet inserted therebetween.

18. The method of claim 14, wherein said step of folding the sheet to form said crease comprises gripping the sheet in a folding mechanism which extends only partway across said sheet to form said crease, while leaving an edge portion uncreased to define said loop.

* * * * *